United States Patent [19]

Cholet

[11] 4,222,447

[45] Sep. 16, 1980

[54] DRILL BIT WITH SUCTION JETS

[75] Inventor: Henri Cholet, Le Pecq, France

[73] Assignee: Institut Francais du Petrole, Rueil-Malmaison, France

[21] Appl. No.: 962,578

[22] Filed: Nov. 21, 1978

[30] Foreign Application Priority Data

Nov. 21, 1977 [FR] France ..... 77 35135

[51] Int. Cl.[2] ..... E21B 9/08

[52] U.S. Cl. ..... 175/340

[58] Field of Search ..... 175/65, 67, 70, 100, 175/213, 339, 340, 393; 299/81

[56] References Cited

U.S. PATENT DOCUMENTS

| | | | |
|---|---|---|---|
| 2,776,115 | 1/1957 | Williams, Jr. | 175/339 |
| 3,070,182 | 12/1962 | Runte | 175/339 |
| 3,111,179 | 11/1963 | Albers et al. | 175/393 |
| 3,144,087 | 8/1964 | Williams, Jr. | 175/339 |
| 4,083,417 | 4/1978 | Arnold | 175/339 X |

FOREIGN PATENT DOCUMENTS

| | | | |
|---|---|---|---|
| 2529380 | 1/1976 | Fed. Rep. of Germany | 175/340 |

*Primary Examiner*—James A. Leppink

*Attorney, Agent, or Firm*—Millen & White

[57] ABSTRACT

A rotary drilling tool has a plurality of rollers, each of which is provided with a specific pair of jets comprising a flushing jet having a downwardly directed component and an upwardly directed eduction jet, these jets being formed on both sides of the plane defined by the bit axis and the roller axis, and the flushing jet being inclined by at least 20° on said plane and substantially tangent to the active part of the roller.

10 Claims, 4 Drawing Figures

11
Fa
8a
9
7
3a
Y'
Y
X'
X
α
10
2
7a
5
8
F
12
H
L 6
4
Fa
8a
2
F
8
3
7a
3a
1

DRILL BIT WITH SUCTION JETS

The present invention relates to a drill bit. More particularly, but not limitatively, this invention relates to a drill bit to be secured to the lower end of a drill string, this drill bit comprising a plurality of rotary elements provided with ground cutting means, these elements being, for example, conical rollers rotatably mounted on roll bearings whose axes are inclined relative to the central axis of the bit.

In the past the efficiency of such drill bits used for drilling bore holes in the ground has been improved by the action of fluid jets whose main functions were to cool the bit, to clean it as well as the hole bottom, and to carry away the ground cuttings.

In particular, a first type of bit has been proposed wherein the fluid jets are all oriented in the direction of advance of the bit and only the cooling function is adequately performed. A modification in shape of these drill bits such that the fluid jets be generated in the close vicinity of the hole bottom could not avoid the regrinding of the ground cuttings, which substantially reduces the bit efficiency. Moreover these fluid jets produce on the hole bottom an over pressure which packs the ground formations and it appears that the contact zone between the bit and the hole bottom where the cuttings are formed is not sufficiently irrigated by the drilling fluid.

In a second type of drill bits according to the prior art, it has been proposed to associate to the flushing jets, suction or eduction means for carrying away the fluid loaded with ground cuttings, these means comprising an additional fluid jet in a direction opposite to that of the drilling advance. Some embodiments of this second type of drill bit were satisfactory, particularly with respect to the discharge of the ground cuttings and this has resulted in a higher efficiency of the drill bits of this second type as compared to those of the first mentioned type.

The present invention provides a drill bit of the above-defined second type whose design results in a more effective cleaning of the bit and of the hole bottom, and accordingly in a further increase in the bit efficiency.

The invention will be clearly understood and all the advantages thereof made apparent from the following description illustrated by the accompanying drawings showing, by way of example, a bit according to the invention having two rotary cutting elements.

DESCRIPTIONS OF DRAWINGS

Figure 2:
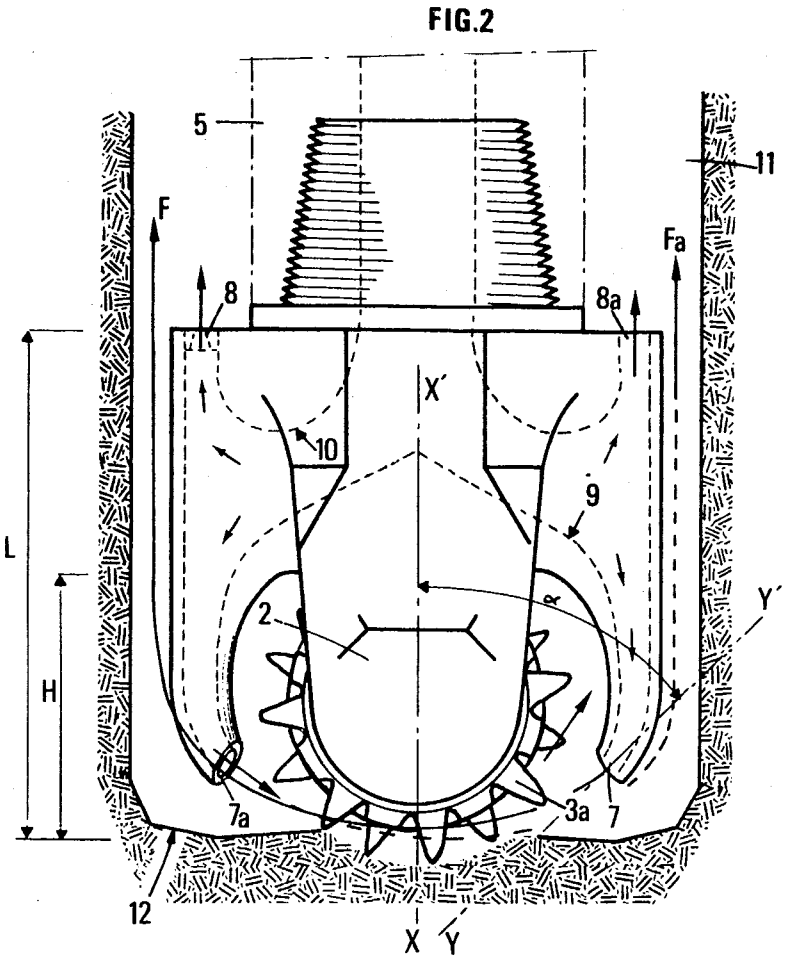
FIG. 2 is a schematic illustration of the drill bit within a bore hole.
Figure 1:
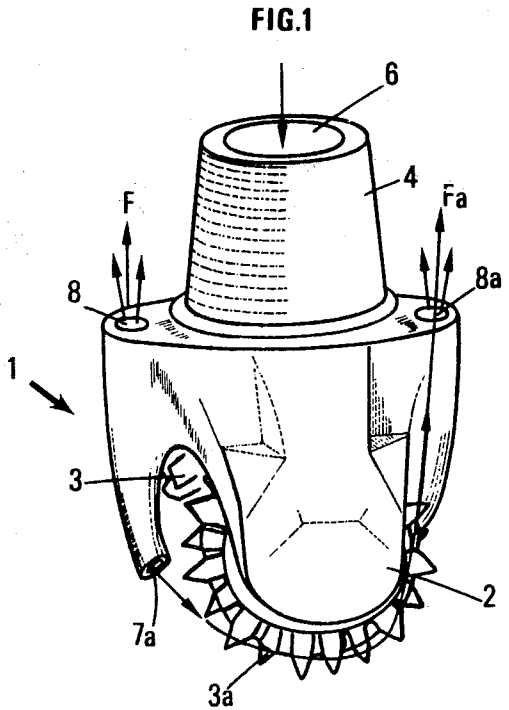
FIG. 1 is a perspective view of the drill bit according to the present invention.
Figure 2A:
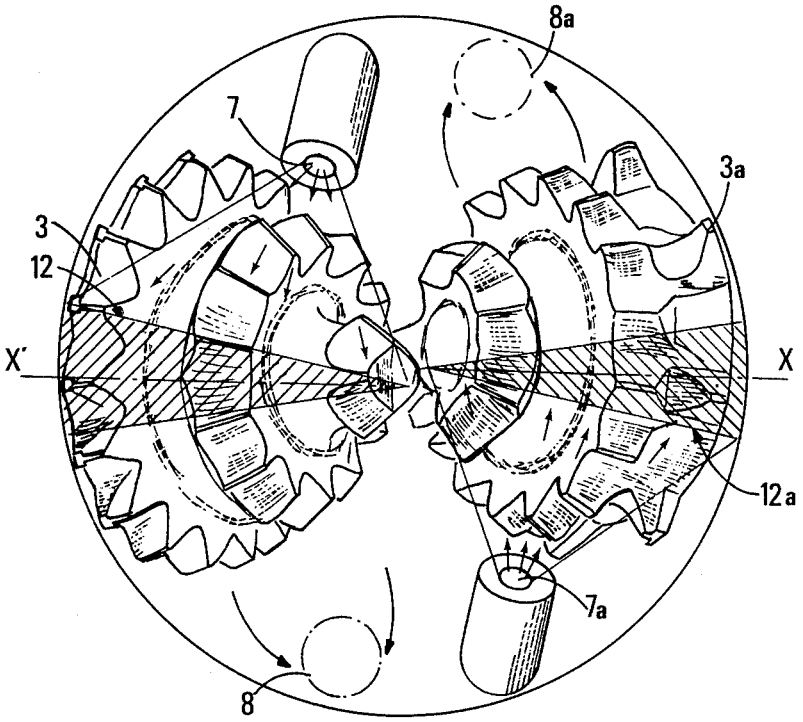
FIG. 2A is a bottom view of the drill bit of the embodiment of FIGS. 1 and 2 of this invention.
Figure 3:
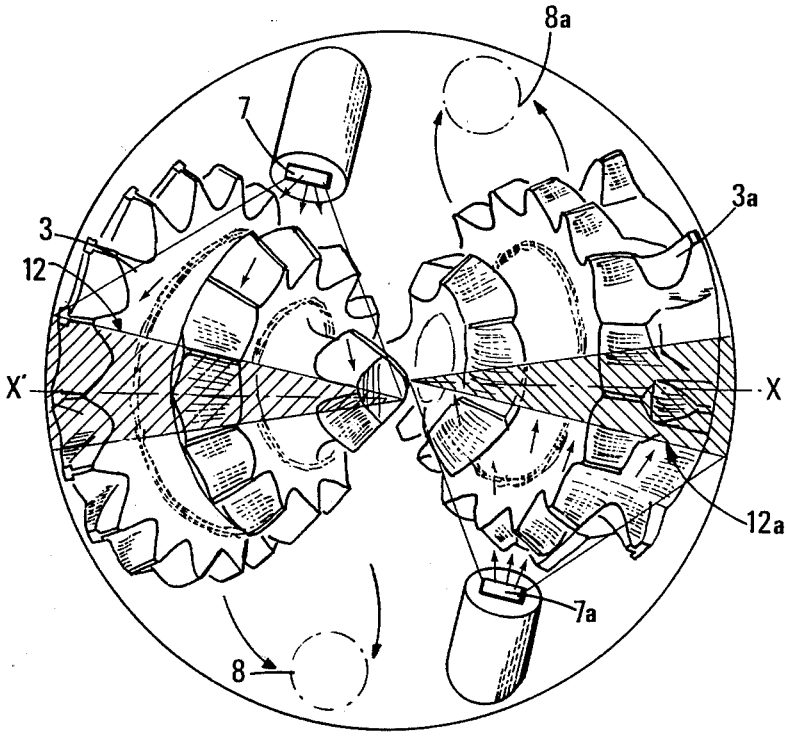
FIG. 3 is a bottom view of an alternative embodiment of the drill bit of this invention (provided with an aperture of the flushing jets nozzles of elongate shape in a direction parallel to a plane tangent to the corresponding cutting elements).

FIGS. 1 and 2 show a drill bit with a body 1 provided with two arms of which only one (arm 2) is shown in the drawings, each of these arms carrying a ground cutting element (elements 3 and 3*a*). This element is, for example, constituted by a roller or conical cutting element rotatably mounted on roller bearings (not shown) whose axes are inclined with respect to the vertical axis of the bit. This rotary cutting element may be of a known type and may comprise teeth as shown in the drawings, or any other cutting means capable of cutting and disaggregating the ground at the bore hole level.

The drill bit is threaded at its upper part 4 to permit connection of the bit with bit holder means adapted to rotate this bit. Such bit holder means may be formed by the drill string, in the case of the rotary drilling process. Alternatively when the bit is directly rotated by a downhole motor, the bit holder means will be formed by the rotor of this downhole motor.

In the bit body 1 is provided a recess 6 which is in direct communication with the inner bore of the drill string.

The bit comprises, for each of the ground cutting elements 3 and 3*a*, flushing means and eduction means for carrying away the drilling fluid loaded with ground cuttings.

The flushing means of element 3 comprises a calibrated aperture 7 which communicates with the recess 6. This aperture 7 is located as close as possible to the rotary cutter 3 and is so arranged as to efficiently irrigate the zone of contact between rotary cutter 3 and the hole bottom. This aperture is preferably so positioned that the fluid jet escaping therefrom has a component in the direction of advance of the drill bit and a component parallel to the hole bottom oriented in the direction of displacement of rotary cutter 3, in the zone where this cutter is in contact with the hole bottom.

The angle $\alpha$ between the axis Y'Y of the calibrated aperture 7 and the plane X'X defined by the bit vertical axis and the rotation axis of the rotary cutter, will be at least equal to 20°. Tests performed on a bi-cones bit have given excellent results with an angle $\alpha$ close to 60°.

To provide a good irrigation of the zone of contact between rotary cutter 3 and the hole bottom, the axis Y'Y of calibrated aperture 7 is located in a plane close to the mediator plane of the theoretical line 12 of contact of cutter 3 with the hole bottom. This mediator plane is substantially at right angles to the above-defined plane X'X.

The calibrated aperture 7 may be of circular shape but will have preferably the shape of a slot (not shown) whose greatest dimension is parallel to the above-defined line 12.

The suction or eduction means are formed by at least one calibrated aperture 8 which communicates with the recess 6. This aperture is located on the side opposite the flushing aperture 7, with respect to the rotary cutter 3 and so designed that during the bit operation the discharged fluid forms an eduction jet which flows in the annular space 11 comprised between the drill string 5 and the drilled bore hole in a direction having a component oriented in the direction opposite to that of advance of the bit.

This eduction aperture is at a distance L from the hole bottom at least equal to the height H of the rotary cutter 3, measured parallelly to the direction of advance of the bit.

As shown in FIG. 2, the communication between the calibrated apertures 7 and 8 and the recess 6 is established through profiled ducts 9 and 10 respectively, such that pressure drops in the fluid flow are reduced to a minimum, these ducts being tangentially connected to the wall of recess 6.

During operation of the bit the fluid is discharged through the calibrated aperture 7 to flush the hole bottom on the active parts or teeth of cutter 3 and to carry away the ground particles or cuttings removed by the cutter teeth. The fluid loaded with ground cuttings is then immediately carried into the annular space 11 under the action of the negative pressure created by the fluid jet discharged through aperture 8 (FIG. 2).

It has been experimentally ascertained that this design not only results in an efficient cooling of the bit, but also in a scavenging of the hole bottom and in a complete removal of the ground cuttings within a very short time interval. It results therefrom a substantial increase in the efficiency of the drill bit, as compared to prior art tools with a suction effect on the drilling fluid loaded with ground cuttings.

FIGS. 1 and 2 illustrate a drill bit having two rotary cutters. As shown by these drawings, a pair of fluid jets is associated to each rotary cutter, 3 and 3*a*, one of these jets being a flushing jet 7 or 7*a* and the other being a suction or eduction jet 8 and 8*a* for carrying away the drilling fluid loaded with ground cuttings (jet pair 7–8 for cutter 3, jet pair 7*a*–8*a* for cutter 3*a*).

Although the drawings show, by way of example only, drill bits having two rotary cutters, it should be understood that the invention can be applied irrespective of the number of rotary cutters, by providing each of them with its own flushing means and its own suction or eduction means, separate from the flushing means and from the eduction means of the other rotary cutters.

Changes may be made, without departing from the scope of the present invention. For example the calibrated apertures may consist of interchangeable nozzles, the operator selecting the diameter of such nozzles in dependence with the operating conditions. Ducts such as ducts 9 and 10 may be either directly formed in the bit body or may consist of separate elements detachably secured to the bit body or fast therewith.

Additional suction means for the drilling fluid loaded with ground cuttings, which may for instance comprise a venturi, may be positioned above each eduction jet.

What I claim is:

1. In a rotary drill bit comprising a body adapted to be connected to rotating means, said body having an internal recess for receiving drilling fluid under pressure and being provided with a plurality of arms, a rotary element provided with ground cutting means rotatably mounted on each of said arms, means for flushing the hole bottom with drilling fluid, said means for flushing the hole bottom with drilling fluid being connected to said recess and comprising flushing nozzles adapted to deliver fluid jets having a component oriented in the direction of advance of said drill bit, and eduction means, also connected to said recess, said eduction means comprising nozzles adapted to generate eduction jets for carrying away the ground cuttings, said eduction jets having a component in a direction opposite to the direction of advance of said drill bit, the improvement wherein each of said rotary elements of said drill bit comprises a pair of nozzles, each of said pairs of nozzles comprising one flushing nozzle and one eduction nozzle, each of said flushing nozzles having a jet aperture opening on one side of a plane defined by the drill bit axis and by the rotation axis of each of said rotary elements, and each of said eduction nozzles having a jet aperture opening on the opposite side of said plane defined by the drill bit axis and by the rotation axis of each of said rotary elements, the axis of said jet aperture of each of said flushing nozzles being inclined by at least 20° to said plane and being substantially tangential to the outer surface of said rotary element provided with ground cutting means.

2. A rotary drill bit according to claim 1, wherein the axis of said jet aperture of each of said flushing nozzles is further so inclined that each of said fluid jets reaches the bottom of the hole within a zone of contact of each of said rotary elements with said bottom of the hole at some distance from the point of intersection of said drill bit axis with said bottom of the hole.

3. A rotary drill bit according to claim 1, wherein said jet aperture of each of said flushing nozzles is of elongate shape with a directon of elongation substantially parallel to a plane tangent to said rotary element at the position of contact of said rotary element with the bottom of the hole.

4. A rotary drill bit according to claim 1, wherein the inclination of the axis of said jet aperture of the flushing nozzle relative to said plane is substantially equal to 60°.

5. A rotary drill bit according to claim 1, wherein each of said eduction means is connected to said recess at a distance L, said distance L being at least equal to the respective height H of each of said rotary elements, said respective height H of each of said rotary elements being measured parallely to the direction of advance of said rotary drill bit.

6. In a rotary drill bit comprising a body adapted to be connected to rotating means, said body having an internal recess for receiving drilling fluid under pressure and being provided with a plurality of arms, a rotary element provided with ground cutting means rotatably mounted on each of said arms, means for flushing the hole bottom with drilling fluid, said means for flushing the hole bottom with drilling fluid being connected to said recess and comprising flushing nozzles adapted to deliver fluid jets having a component oriented in the direction of advance of said drill bit, and eduction means, also connected to said recess, said eduction means comprising nozzles adapted to generate eduction jets for carrying away the ground cuttings, said eduction jets having a component in a direction opposite to the direction of advance of said drill bit, the improvement wherein each of said rotary elements of said drill bit comprises a pair of nozzles, each of said pairs of nozzles comprising one flushing nozzle and one eduction nozzle, each of said flushing nozzles having a jet aperture opening on one side of a plane defined by the drill bit axis and by the rotation axis of each of said rotary elements, and each of said eduction nozzles having a jet aperture opening on the opposite side of said plane defined by the drill bit axis and by the rotation axis of each of said rotary elements, the axis of said jet aperture of each of said flushing nozzles being inclined by at least 20° to said plane and being substantially tangential to the outer surface of said rotary element provided with ground cutting means, each of said flushing nozzles being further so oriented as to direct said fluid jets in the direction of rotation of each of said ground cutting means rotatably mounted on each of said arms.

7. A rotary drill bit according to claim 6, wherein said jet aperture of each of said flushing nozzles is of elongate shape with a direction of elongation substantially parallel to a plane tangent to said rotary element at the position of contact of said rotary element with the bottom of the hole.

8. A rotary drill bit according to claim 6, wherein the inclination of the axis of said jet aperture of the flushing nozzle relative to said plane is substantially equal to 60°.

9. A rotary drill bit according to claim 6, wherein each of said eduction means is connected to said recess at a distance L, said distance L being at least equal to the respective height H of each of said rotary elements, said respective height H of each of said rotary elements being measured parallely to the direction of advance of said rotary drill bit.

10. A rotary drill bit according to claim 6, wherein the axis of said jet aperture of each of said flushing nozzles is further so inclined that each of said fluid jets reaches the bottom of the hole within a zone of contact of each of said rotary elements with said bottom of the hole at some distance from the point of intersection of said drill bit axis with said bottom of the hole.

* * * * *